United States Patent [19]

Holiman et al.

[11] Patent Number: 4,627,581

[45] Date of Patent: Dec. 9, 1986

[54] ANTI-FOUL DEVICE FOR TIRE CARCASS CUTTING AND SHREDDING APPARATUS

[75] Inventors: William E. Holiman; Henry O'Keefe, both of Houston, Tex.

[73] Assignee: Tire-Gator, Inc., Houston, Tex.

[21] Appl. No.: 747,847

[22] Filed: Jun. 24, 1985

[51] Int. Cl.[4] ..... B02C 18/14

[52] U.S. Cl. ..... 241/167; 241/236

[58] Field of Search ..... 241/166, 167, 236, DIG. 31

[56] References Cited

U.S. PATENT DOCUMENTS

| | | | |
|---|---|---|---|
| 3,656,697 | 4/1972 | Nelson . | |
| 3,718,284 | 2/1973 | Richardson . | |
| 3,727,850 | 4/1973 | Krigbaum . | |
| 3,931,935 | 1/1976 | Holman . | |
| 4,018,392 | 4/1977 | Wagner | 241/167 |
| 4,052,013 | 10/1977 | Ehrlich et al. . | |
| 4,119,277 | 10/1978 | Synder et al. . | |
| 4,185,784 | 1/1980 | Flita | 241/167 X |
| 4,235,383 | 11/1980 | Clark . | |
| 4,241,882 | 12/1980 | Baikoff . | |
| 4,374,573 | 2/1983 | Rouse et al. . | |

*Primary Examiner*—Mark Rosenbaum

*Attorney, Agent, or Firm*—Laurence R. Brown

[57] ABSTRACT

The present disclosure is directed for use with a tire carcass shredding apparatus having a base frame in which are journalled at least one pair of opposed parallel shafts on which are carried slotted mandrels and cutter blades having spacers between each adjacent mandrel and cutter blade all being spline mounted for rotation with the shafts. The cutter blades are carried by one shaft entering the slots of the mandrels of the opposed shaft. The anti-foul device of this invention has a support bar for each of the opposed parallel shafts. Clean-out fingers and anti-foul fingers are positionable along the support bars for cleaning the zone of interdigitation between the mandrels and cutter blades. There are four fingers positionable along the support bars for interfitting engagement between the cutter assemblies, and there are adjustable connectors between said base frame and each support bar carrying the clean-out fingers and the anti-foul fingers for moving the fingers supported on the support bar toward and away from the cutter blades and mandrels of each shaft to remove debris entrapped within and between the cutter assemblies resulting from shredding tires.

5 Claims, 5 Drawing Figures

FIG. 2
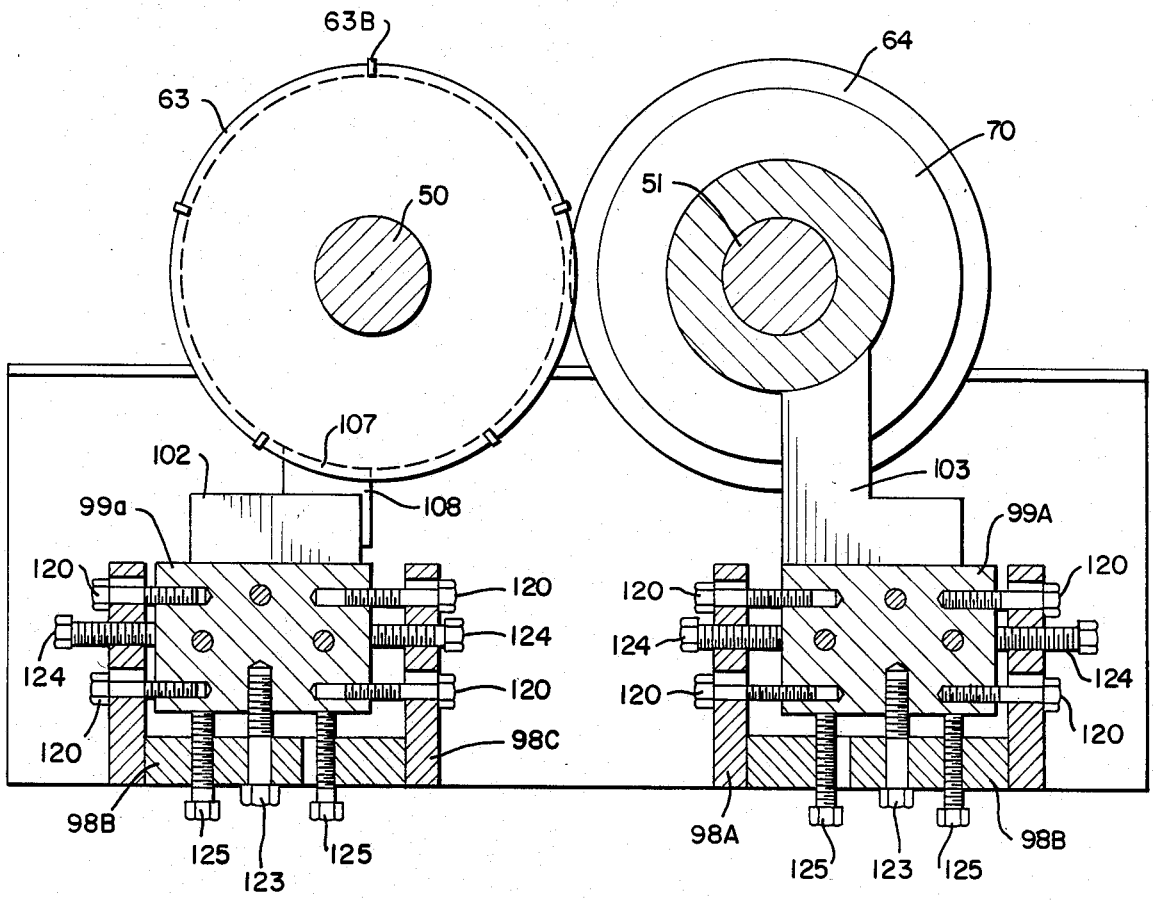
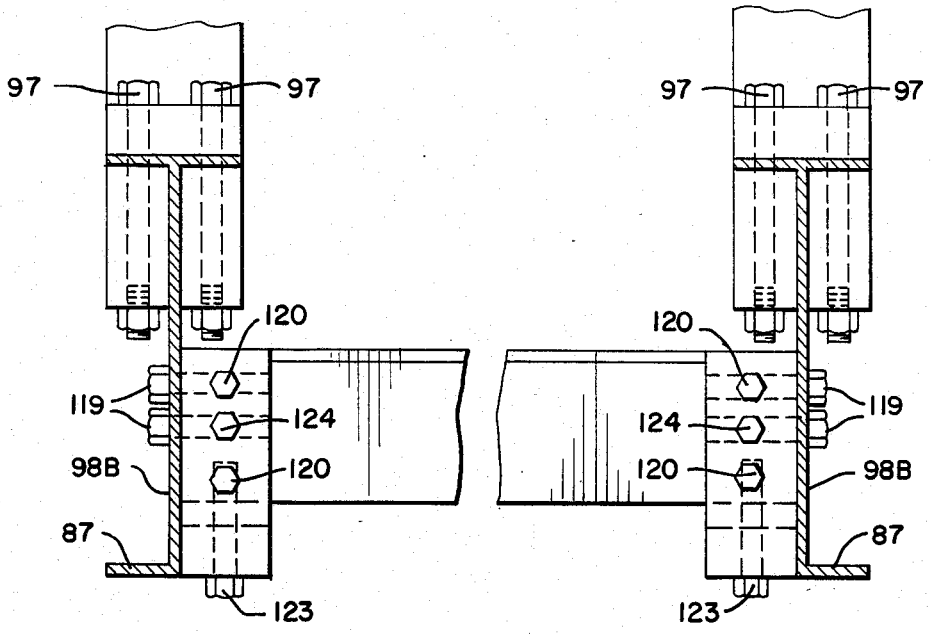
FIG. 3

ANTI-FOUL DEVICE FOR TIRE CARCASS CUTTING AND SHREDDING APPARATUS

BACKGROUND ART

Heretofore, used or old truck and automobile tires have been mechanically cut up or shredded by way of example employing our prior patented machines disclosed in U.S. Pat. Nos. 3,817,463 and 4,081,143 employing a series of pairs of counter rotating discs mounted in interdigitating relationship on opposed shafts.

Known to us prior to the filing of this application are the following U.S. patents in addition to our own:

| | |
|---|---|
| 3,656,697 | 4,052,013 |
| 3,718,284 | 4,119,277 |
| 3,727,850 | 4,235,383 |
| 3,931,935 | 4,241,882 |
| 4,374,573 | |

DISCLOSURE OF THE INVENTION

It is to be noted that this invention incorporates some of the same principles outlined in U.S. Pat. No. 4,081,143 which was issued to William E. Holiman on Mar. 28, 1978; however, improvements are submitted herewith to enable the machine to be more reliable, effective, etc. Due to the tremendous forces applied to the frame and other components when cutting a tire, especially the steel beads at the tire rim, and the cut rubber being capable of clogging in the machine, causing the equipment to stall or component breakage as previously patented, modifications and improvements are necessary to eliminate this problem and are incorporated within the teaching of this patent. The equipment built to the specifications of the original patent has been in operation for a period over 5 years, presenting reoccurring problems with clogging and breakage of components due to clogging. From past experience it has been proved that the equipment must be extra rugged, precision built, aligned and assembled to prevent clogging, breakage, excessive wear and to insure equipment that requires a minimum of maintenance and to reduce breakdown time to a minimum.

The invention provides a fast (over 1000 tires per hour), low horsepower means of cutting automobile and truck tires (including steel-belted), with improved longer lasting cutting blades and mandrels, improved methods of keeping the equipment free of fouling rubber immediately after being cut, and methods of changing components individually and with a minimum of down-time when necessary.

As stated previously the object of this invention is to improve over previous equipment. One of the main objects is to improve the previous equipment as patented under U.S. Pat. No. 4,081,143 by providing an adequate anti-foul system. The design as called for by the previous patent would allow shredded rubber to go into the gaps or space between the cutter blades. This rubber (shredded) had the tendency to remain in the spaces and hang onto the blades, spacers and mandrels and continue to rotate with the cutter assembly and continue to accumulate more and more rubber until the cutter assemblies stalled or some weak components breaking due to the tremendous forces associated with this equipment. Therefore, the present system has recently been developed to remove the shredded rubber immediately after being shredded or cut by the cutter assembly. Also an improved device has been developed to remove the rubber, wire and nylon cord from the mandrel and groove and to further keep the groove clean and free of burrs that may build up in the groove.

BRIEF DESCRIPTION OF THE FIGURES OF DRAWINGS

FIG. 2 is a vertical transverse sectional view through the frame and cutter assembly of FIG. 1 showing the positioning of the anti-foul device of the present invention.

FIG. 3 is a fragmentary sectional view of the frame of FIG. 1 showing the bearing mounts for the shredding shafts.

BEST MODE FOR CARRYING OUT THE INVENTION

Figure 1:
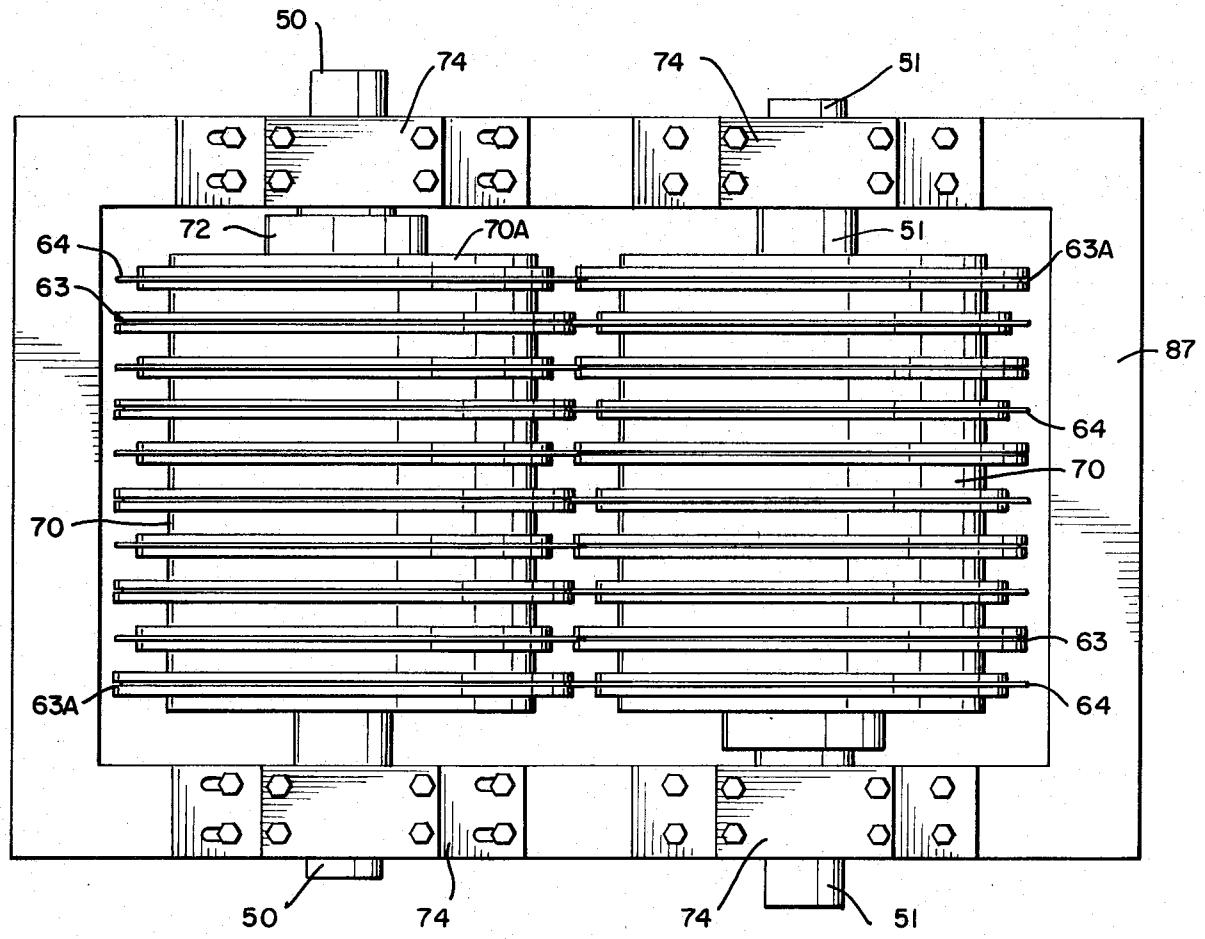
FIG. 1 is a top plan view of the machine frame and shredding tire carcass cutters with which the present invention is employed.
Figure 4:
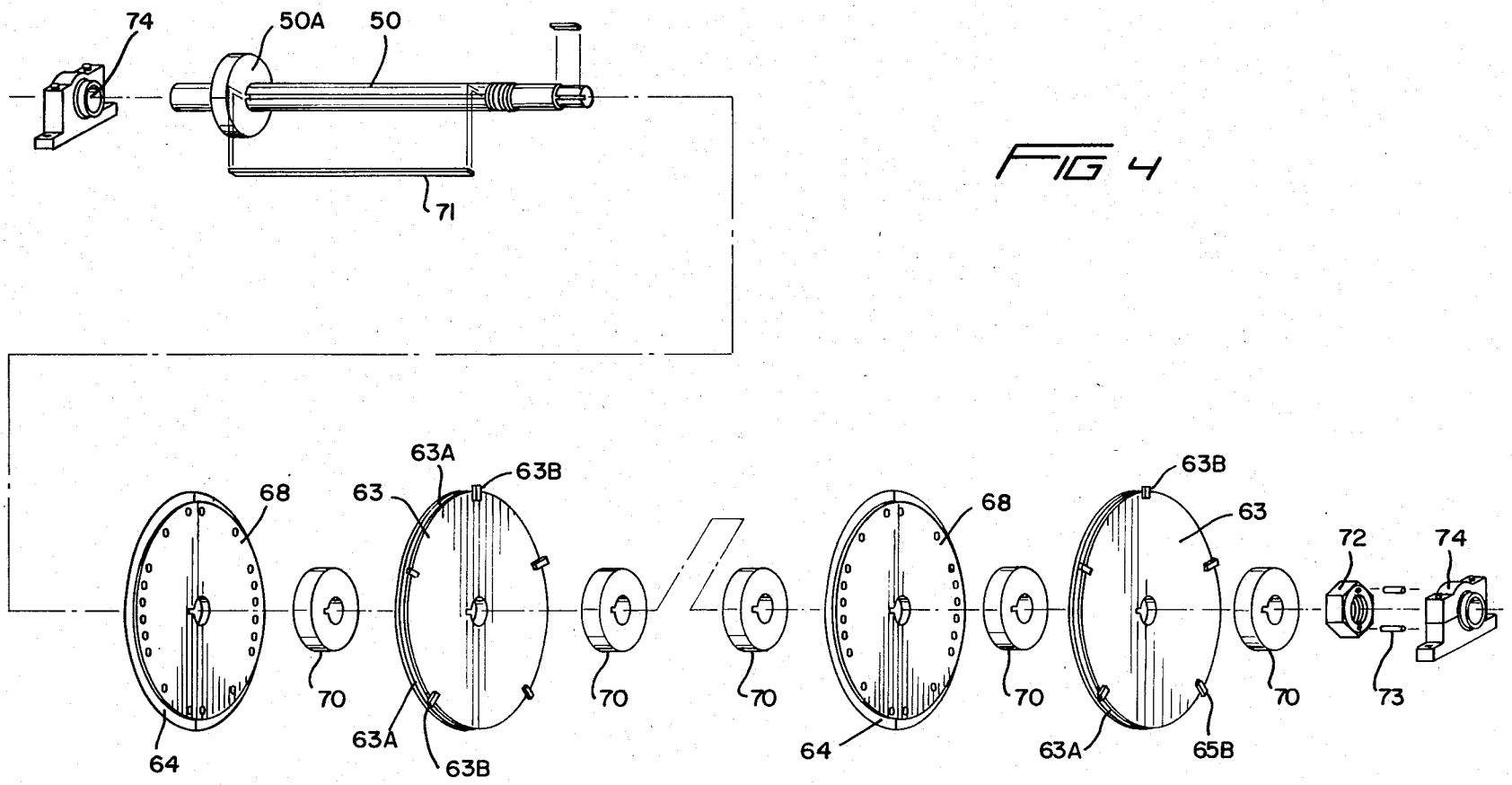
FIG. 4 is an exploded perspective view of one of the cutter disc and mandrel support shafts for use with the tire shredder of the present invention.
Figure 5:
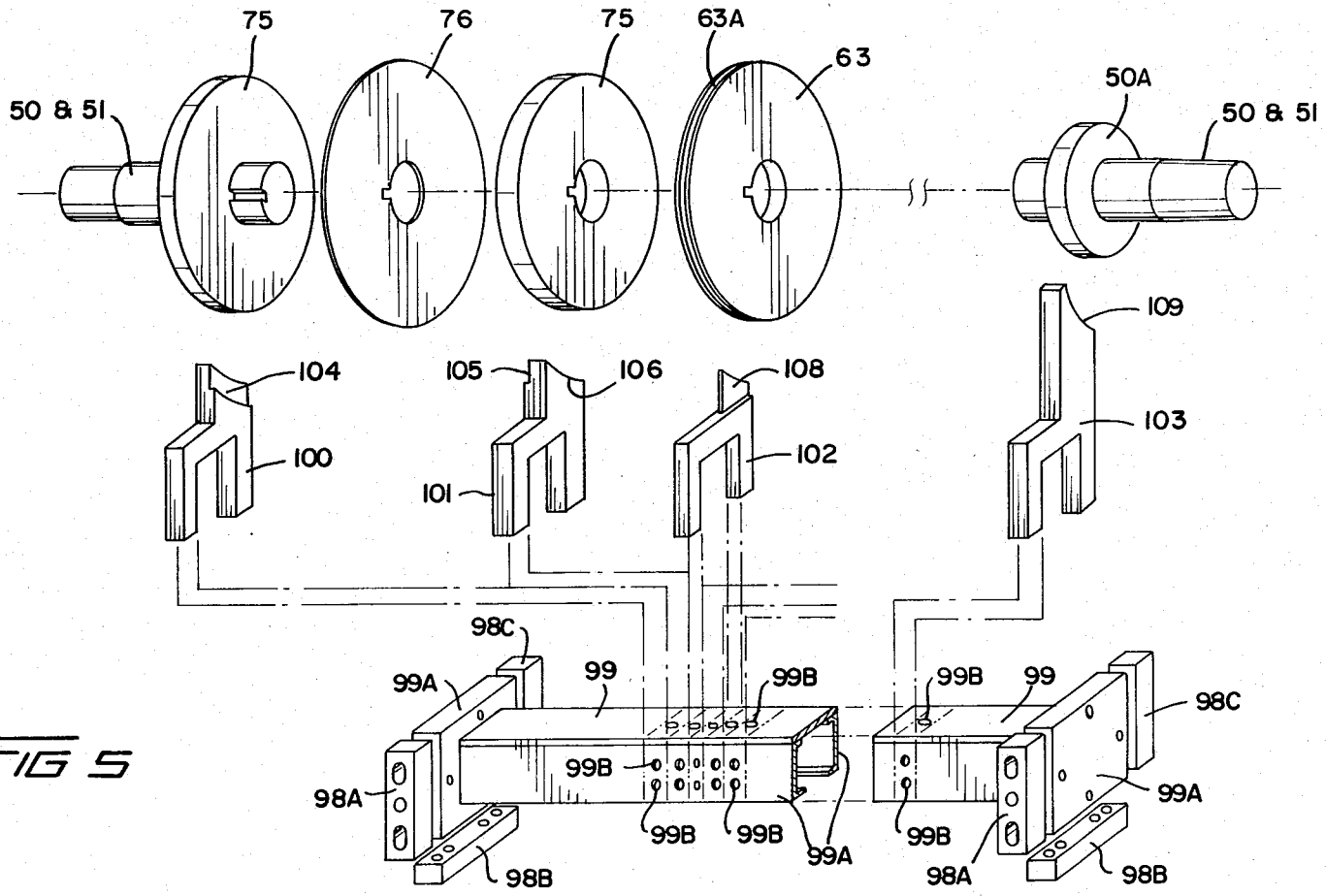
FIG. 5 is an exploded perspective view of the anti-foul device of the present invention used with the carcass cutters and shredders of FIG. 1.

Now with general reference to the perspective views of FIGS. 4 and 5, and the corresponding plan and sectional views of the cutter assembly, FIG. 1 and FIGS. 2, 3, 4 and 5, the general operation and assembly of the rotary shredders and their anti-foul system may be more readily visualized.

As may be seen best from FIGS. 1, 2, 4 and 5, the cutter wheels are respectively a mandrel 63 and cutter blade 64 in contact with each other and they are alternatively positioned along each of the shafts 50, 51 to thereby provide a feed direction downwardly by means of both the circumference and sides of the mandrels 63 assisted by a feed assist unit and the feed fingers 63B as described in U.S. Pat. Nos. 4,081,143, 3,817,463 and 3,727,850; however, the feed fingers 63B only protrude out from the mandrel 63 between $\frac{3}{8}$ inch and $\frac{1}{4}$ inch and the point is not sharp enough to dig into the tire to become in contact with the steel in the tires. The tires are fed downwardly through the gaps between the cutter blades 64 and the mandrels 63. The root of the cutter blades 64 are into the mandrel groove 63A by 1/16 inch. Now the groove of the mandrel 63A being a few thousandth's of an inch narrower than the blades 64, the blade 64 being of Magalloy, the blade 64 forms it's own slip fit in the groove 63A. The edge of the blades 64 being in contact with the edge of the groove 63A shears the rubber as a pair of scissors cutting cloth. The steel belts of the tire is sheared as with an ordinary metal shear. The steel head at the rim of the tire being made of individual strands of small wire, the bead is mostly flatten and sheared. The units act as a shear instead of tearing the tires apart. This action gives a clean uniform cut. Magalloy being a tough abrasive alloy is specified as it is self-sharpening and keeps the groove 63A clean and free from metal build-up in the grooves 63A and forms it's own fit as the mandrel 63 wears with normal use. The previous patent called for SSS1000 alloy steel for the anvils (hereafter called mandrels 63) and the cutter blades 64 to be made from Rockwell 49 tool steel (into 3=120 degree sectors).

This application calls for the mandrels 63 to be made from ARS-360 or T-1 alloy steels. The specified alloys renders the equipment more durable, tough, excellent wear-resistance and self-sharpening.

The mandrels 63 and the cutter blades 64 shown in FIGS. 4 and 5, and the groove 63A is cut in the mandrels 63 a few thousandths of an inch less than 0.250 inch (6.35 mm) wide to accommodate the cutter blades 64 or 76 which is 0.250 inch (6.35 mm) thick. A close fit is required with the blades 64 or 76 entering the mandrel 63 groove 63A approximately 1/16 inch (1.5875 mm) deep. A close fit is obtained by adjusting the right cutter assembly into the left cutter assembly by means of adjusting bolts. Naturally, the rotary cutters must be turning and the Magalloy blades 64 or 76 will form their own fit. The groove 63A is out ½ inch (12.7 mm) deep into the mandrel 63 to collect any rubber, wire or nylon cord that is cut by the shoulders of the groove 63A and also allow for grinding the outside circumference of the mandrels 63 due to wear from normal use or other reasons. As the blades 64 or 76 wears, which is very little when made from Magalloy, the right cutter assembly may be adjusted further into the left cutter assembly (which is stationary) by loosing the 4 hold-down bolts 97 on the front and rear bearings.

Since all mandrels 63, spacers 70, 75, cutter wheels 68 and the cutter blades 64 or 76 are manufactured under precision conditions, flat and parallel within 0.002 inch (0.0508 mm), this method will reduce the mandrel 63 groove 63A and the cutter blades 64 or 76 runout to a minimum, and since the right and left cutter assemblies are made alike this method will also insure proper and close alignment when one is turned opposite the other to be installed in the bearings 74 on the main frame. This alignment is a necessity to reduce wear of the groove 63A and to insure good cutting ability over a prolonged period of time. It is also a necessity for the proper alignment of the anti-foul system.

FIG. 5 shows an exploded view or schematic of the anti-foul fingers, support bar and clean-out fingers for the 26 inch (66.04 cm) diameter cutter assembly. The view shows one complete set of anti-foul fingers 100, 101 and clean-out fingers 102 and the anti-foul finger 103 for the positive stop 50A, 51A which is made an integral part of the shafts 50, 51 (FIG. 5) and further shows their relationship to the mandrels 63, cutter blades 76 and spacers 75 and 50A.

FIG. 5 shows an exploded view or schematic of the anti-foul fingers and clean-out fingers for the 30 inch (0.762 m) diameter cutter assembly. The anti-foul support bar for this unit is the same as for the 26 inch (66.04 cm) diameter cutter assembly, except for the mounting holes 99B. The mounting holes 99B are drilled in place from a reference line at the end of the anti-foul support bar 99 in a precision manner in order that the unit is assembled, the anti-foul fingers and clean-out fingers will line up with the cutter assembly.

The positive stop spacers 50A, 51A are the same diameter as the other spacers 70 or 75 for any particular unit. The height of the anti-foul fingers 100, 101 and 103 and the clean-out fingers 102 should be as low or short as possible to reduce the leverage action due to forces applied to them. Further, they are manufactured with such geometrical shape that the moment of inertia is great enough to resist any bending moments. Parts 98A, 98B and 98C are welded to the inside of the main frame 87 (front and back respectfully). The front of the anti-foul fingers 100, 101 and 103 and the clean-out fingers 102 being placed directly under the vertical centerline of each cutter assembly. The space allowed between any finger and it's opposing part, i.e., a spacer 70 or 76 and the anti-foul fingers 100, 101 when manufactured and assembled is approvimately 0.010 inch (0.2540 mm). This measure is taken to prevent large pieces of rubber, wire and nylon cord from clogging the machine, the rubber also be deflected out of the gaps between the mandrels 63 and cutter blades 65 or 76 immediately after being cut. They will remain in the feed path for further processing in the next unit or as a final product.

In the event the machine becomes fouled by debris, the conveyors are stopped, also the cutter assemblies. The cutter assemblies are then reversed in rotation (either automatically or by the operator) and cleared of the debris. The anti-foul system as designed removes all rubber, wire and nylon cord left in immediate contact with the cutter assemblies and deflects that small amount off to the sides of the unit when reversed.

The anti-foul fingers 100 and 101 are identical except one being the left-hand finger while the other is considered the right-hand finger. There are 3 circular grooves milled into each of these fingers. The grooves are indicated 109, 110, 111, 105 and 104. Groove 109 has a radius of 0.010 inch (0.2540 mm) larger than the spacer 70. Grooves 110 and 111 has a radius of 0.010 (0.2540 mm) larger than the outside radius of the cutter wheel and is 0.010 inch (0.2540 mm) deeper than ½ the width of the cutter wheel 68. Grooves 104 and 105 has a radius 0.010 (0.2540 mm) greater than the outside radius of the cutter blade 64 and has a depth 0.010 (0.2540 mm) greater than ½ the thickness of the blade 64.

The anti-foul finger 103 has only 1 circular groove 109 and is the same as above.

The clean-out finger 102 has a slot milled as shown and a piece of Magalloy is welded in the slot. The piece of Magalloy 108 is employed to fit in the groove 63A of the mandrel 63 and keep it free of rubber, wire and nylon cord immediately after a tire or other pieces of rubber is cut or shredded. It also keeps the bottom and sides of the groove free from nicks and dents that might accumulate in it.

It will be noted that the anti-foul finger 101 has one additional groove 106 to accommodate the feed fingers 63B which is welded on the side of the mandrel 63. The radius of the groove 106 is approximately 0.015 inch (0.381 mm) greater than the radius the feed finger makes. The feed finger 63B only protrudes out from the outside diameter of the mandrel 63 no more than ⅜ inch (9.525 mm).

As stated previously, it is the purpose of the anti-foul system to keep large pieces of rubber, wire and nylon cord from remaining in the cutter assemblies to clog them, but yet, to design a system that will permit all rotating components to operate within it's boundaries freely without binding or dragging. This system serves it's purpose.

The anti-foul support bar 99 is constructed of a channel 99C with a ½ inch (12.7 mm) thick steel plate welded as shown in it's cross-sectional view FIG. 5 to it. The top, bottom and two sides are milled square and parallel with each other to close tolerances in order that the horseshoe shaped gap of the anti-foul fingers 100, 101 and 103 and the clean-out finger 102 will fit thereon with only a slip-fit. Two solid plates 99A are joined to the support bar 99, one at each end, by welding. They are also milled square and the ends are milled parallel to each other after welding to the support bar 99, the length of the support bar being approximately ¼ inch (6.35 mm) shorter than the inside dimension of the frame in the front-back direction. When assemblied under the vertical centerline of the cutter assemblies, the support bar 99 and 99A is adjusted axially parallel with the cutter assemblies with shims at each end. The shims are placed as necessary to assure that the clean-out finger 102 and the anti-foul fingers 100, 101 and 103 line up with their mating parts of the cutter assembly.

From FIGS. 2 and 3 it will be seen that the anti-foul system can be adjusted in or out from the vertical centerline of the cutter assembly with bolts 120. The system can be raised or lowered with bolts 123. When the anti-foul system is in its proper position bolts 120, 124, 123 and 125 are completely tightened, acting as lock bolts and a backstop in either direction. Last the bolts 119 are tightened, holding the anti-foul system rigidly in position to the main frame 87.

The main frame 87 as outlined in the prior U.S. Pat. No. 4,081,143 was not adequate due to the very high forces applied to it. Since most of the force between two cutter assemblies are in the outward direction causing tension a new frame was devised.

The new frame consists of a wide flange beam 127, 18 inch by 35 lb. Four solid steel bars 126 are welded to the front and back of the frame 87 as shown in FIG. 13A. The bearings 74 are bolted to these bars. The bars 126 will carry most of the stress encountered between the two cutter assemblies. The channels 128 are welded to the wide flange beam 127 as shown. The ½ inch plates 129 are then welded as shown 13 and 13A. The front and back plates 129 has access holes cut or milled into them in order to reach the anti-foul system bolts 119.

It is to be noted that the frame is built as shown to form a geometrical shape to increase the moment of inertia and to distribute the stresses more evenly in all area of the section and to eliminate the frame from breathing as previously experienced.

What we claim is:

1. For use with a tire carcass shredding apparatus having a base frame in which are journalled at least one pair of opposed parallel shafts on which are carried slotted mandrels and cutter blades having spacers between each adjacent mandrel and cutter blade all being spline mounted for rotation with each shaft and forming cutter assemblies, the cutter blades being carried by one shaft entering the slots of the mandrels of the opposed shafts; an anti-foul device comprising an inverted U-shaped support bar means for each of said opposed parallel shafts, clean out fingers and anti-foul fingers carried by and positionable along the major axis of said inverted U-shaped support bar means for cleaning interdigitation between said mandrels and cutter blades, there being foul fingers positionable along each said support bar means and the axis of said cutting mandrels and discs for engagement with the cutter assemblies, and means adjustably connected between said base frame and each support bar means carrying said clean out fingers and said anti-foul fingers for moving the fingers securely supported on said U-shaped support bar means toward and away from the cutter blades and mandrels of each cutter assembly to remove debris entrapped within and between said cutter assemblies resulting from shredding tires.

2. An anti-foul device as claimed in claim 1 wherein each of said support bar means have three right angled flat sides and extend along the length of said parallel shafts.

3. An anti-foul device as claimed in claim 2 wherein said means adjustably connected between said base frame and each support bar are threaded adjusting bolt connections movable both vertically and horizontally to move said fingers toward and away from said cutting mandrels and discs carried by the shaft adjacent each of said pair of opposed parallel shafts.

4. An anti-foul device as claimed in claim 3 wherein said anti-foul fingers and clean out fingers are securely mounted on said inverted U-shaped support bar means the open inner portions of which are flat and complemental to the three right angled flat sides of said support bar means, said U-shaped supports being fixably positionable along said support bars and the axis of said cutting mandrels and discs to maintain a cleaning position of the fingers relative to said mandrels and cutting discs to assure removal of debris from between and among said mandrels and cutting discs.

5. For use with a tire carcass shredding apparatus having a base frame in which are journalled at least one pair of opposed parallel shafts on which are carried slotted mandrels and cutter blades having spacers between each adjacent mandrel and cutter blade all being spline mounted for rotation with each shaft and forming cutter assemblies, the cutter blades being carried by one shaft entering the slots of the mandrels of the opposed shafts; an anti-foul device comprising support bar means for each of said opposed parallel shafts, clean out fingers and anti-foul fingers carried by and positionable along the major axis of said support bar means for cleaning interdigitation between said mandrels and cutter blades, there being four of said clean out and anti-foul fingers positionable along each said support bar means and the axis of said cutting mandrels and discs for engagement with the cutter assemblies, each of said support bar means forming an inverted U-shaped support having three right angled flat sides which extend along the length of said parallel shafts, and means adjustably connected between said base frame and each support bar means securely carrying said clean out fingers and said anti-foul fingers for moving the fingers supported on said support bar means toward and away from the cutter blades and mandrels of each cutter assembly to remove debris entrapped within and between said cutter assemblies resulting from shredding tires, said anti-foul fingers and clean out fingers being securely mounted on said inverted U-shaped support the open inner portions of which are flat and complemental to the three right angled flat sides of said support bar means.

* * * * *